US009109475B2

(12) United States Patent
Mitsuhashi

(10) Patent No.: US 9,109,475 B2
(45) Date of Patent: Aug. 18, 2015

(54) CONTROL SYSTEM FOR AN INTERNAL COMBUSTION ENGINE

(75) Inventor: Hideo Mitsuhashi, Isehara (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 545 days.

(21) Appl. No.: 13/405,702

(22) Filed: Feb. 27, 2012

(65) Prior Publication Data

US 2012/0226431 A1 Sep. 6, 2012

(30) Foreign Application Priority Data

Mar. 3, 2011 (JP) ..... 2011-045855

(51) Int. Cl.
*F02D 28/00* (2006.01)
*F01L 1/344* (2006.01)
*F01L 13/08* (2006.01)

(52) U.S. Cl.
CPC ..... *F01L 1/3442* (2013.01); *F01L 13/08* (2013.01); *F01L 2800/01* (2013.01)

(58) Field of Classification Search
CPC ..... F01L 1/3442; F01L 13/08; F01L 2800/00; F01L 2800/05
USPC ..... 123/90.12, 90.15, 90.16, 90.17, 179.3; 701/105, 113
See application file for complete search history.

(56) References Cited

U.S. PATENT DOCUMENTS 6,026,921 A * 2/2000 Aoyama et al. ..... 180/65.25
6,196,174 B1 * 3/2001 Wada et al. ..... 123/90.15
6,202,610 B1 * 3/2001 Yoshiki et al. ..... 123/90.15
6,330,870 B1 * 12/2001 Inoue et al. ..... 123/90.17
6,637,386 B2 * 10/2003 Murata et al. ..... 123/90.15
6,758,177 B1 7/2004 McKay et al.
7,305,957 B2 * 12/2007 Mashiki ..... 123/179.4
2003/0000489 A1 * 1/2003 Majima et al. ..... 123/90.17
2003/0005751 A1 * 1/2003 Berndorfer et al. ..... 73/54.01
2003/0221648 A1 * 12/2003 Ichimoto et al. ..... 123/90.17
2004/0029677 A1 * 2/2004 Mori et al. ..... 477/3
2006/0052216 A1 * 3/2006 Ueura et al. ..... 477/97
2008/0230025 A1 * 9/2008 Ikihara et al. ..... 123/90.17

(Continued)

FOREIGN PATENT DOCUMENTS

CN 101151447 A 3/2008
CN 101839183 A 9/2010

(Continued)

*Primary Examiner* — Mahmoud Gimie
*Assistant Examiner* — John Zaleskas
(74) *Attorney, Agent, or Firm* — Drinker Biddle & Reath LLP

(57) ABSTRACT

An internal combustion engine includes a hydraulically-driven variable valve timing device for adjusting the opening timing and the closing timing of an intake valve and configured to include a start retard position for decompression that is retarded further from the most retarded position during a normal operating state, and a control system configured to start a cranking operation of the internal combustion engine while the variable valve timing device is positioned in the start retard position for decompression, to determine during the cranking operation whether operating oil has drained from the variable valve timing device, when it has been determined that oil has drained from the variable valve timing device, to set a delay time between the cranking operation start and an advance operation of the variable valve timing device longer than the situation in which operating oil is replete.

11 Claims, 5 Drawing Sheets

(56) References Cited

U.S. PATENT DOCUMENTS

| | | | | |
|---|---|---|---|---|
| 2009/0025668 | A1* | 1/2009 | Matsusaka et al. | 123/90.17 |
| 2009/0145380 | A1* | 6/2009 | Wada et al. | 123/90.12 |
| 2009/0183706 | A1* | 7/2009 | Miwa et al. | 123/179.3 |
| 2010/0000478 | A1* | 1/2010 | Yoshikawa et al. | 123/90.15 |
| 2010/0139592 | A1* | 6/2010 | Takemura | 123/90.17 |
| 2010/0192886 | A1* | 8/2010 | Tomimatsu et al. | 123/90.17 |
| 2010/0224153 | A1* | 9/2010 | Ichimoto et al. | 123/90.17 |
| 2010/0236227 | A1* | 9/2010 | Yoshioka | 60/328 |
| 2010/0241322 | A1* | 9/2010 | Miyanoo | 701/54 |
| 2010/0288215 | A1* | 11/2010 | Takemura et al. | 123/90.15 |

FOREIGN PATENT DOCUMENTS

| | | | | |
|---|---|---|---|---|
| EP | 1 672 186 | A1 | | 6/2006 |
| EP | 1 803 905 | A2 | | 7/2007 |
| JP | H05-156911 | | | 6/1993 |
| JP | 2000-154738 | | | 6/2000 |
| JP | 2004092593 | A | * | 3/2004 |
| JP | 2005-098150 | | | 4/2005 |
| JP | 2007085253 | A | * | 4/2007 |
| JP | 2010-195308 | | | 9/2010 |

* cited by examiner

FIG. 3
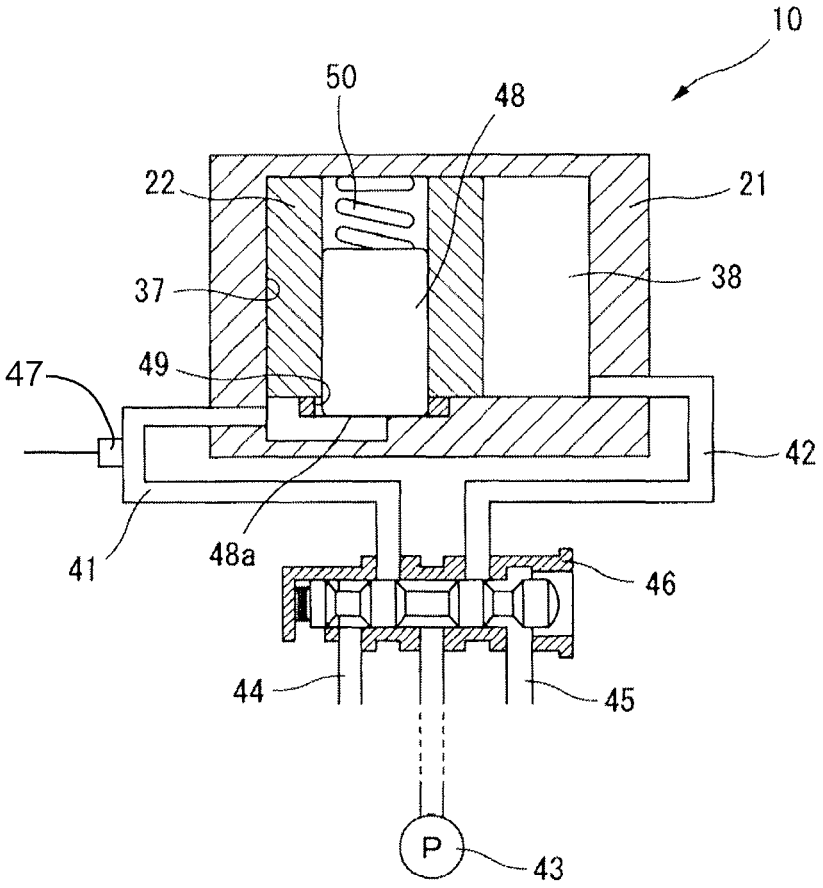
FIG. 4
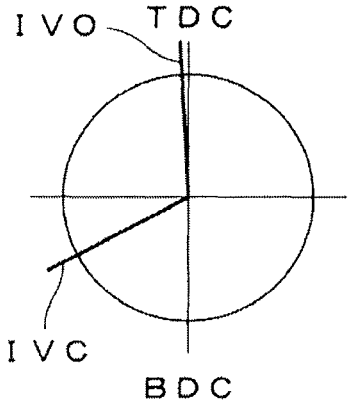
FIG. 4A
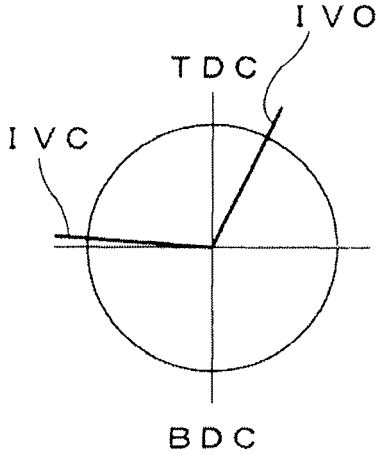
FIG. 4B

CONTROL SYSTEM FOR AN INTERNAL COMBUSTION ENGINE

CROSS-REFERENCE TO RELATED APPLICATIONS

This application claims priority under 35 U.S.C. §119 to Japanese Patent Application No. 2011-045855, filed on Mar. 3, 2011, which is incorporated by reference herein in its entirety.

BACKGROUND OF THE INVENTION

1. Field of Invention

This invention relates to a control system for an internal combustion engine equipped with a variable valve timing device hydraulically driven for selectively advancing or retarding an opening and closing timing of an intake valve.

2. Description of Related Art

Conventionally, in an internal combustion engine (ICE) equipped with a variable valve timing (VVT) device for adjusting an opening and closing timing of an intake valve, the VVT may be used to facilitate startup by performing a decompression operation (DECOMP). In a decompression operation, the cylinder pressure during cranking is suppressed, which helps create a stable or smooth start up of the ICE with reduced vibration. For example, an existing technology used in a hybrid electric vehicle automatically stops and restarts an ICE to save fuel when the vehicle stops at intersections or crossings, and during such restarts, the VVT retards the variable valve timing to a prescribed retarded position (a decompression operation).

When the valve timing is greatly retarded in an ICE during a decompression operation, the charging efficiency of the engine becomes low, and thus an undesirable result may be that the torque generated by the engine is suppressed. Accordingly, it is desirable to advance the VVT device to an original advanced position when the engine is started by a cranking operation. In particular, to ensure acceleration performance, for example to provide a sufficient level of starting acceleration performance in a HEV from the engine auto-stop condition to the auto-start condition in response to the gas pedal being pressed suddenly, an immediate start of control to advance the VVT device is desirable.

SUMMARY OF THE INVENTION

An internal combustion engine for use in a hybrid electric vehicle frequently involves automatic start and stop operations. During an engine stopping state, a determination as to whether operating has oil drains off from the VVC device will be made based on a stopping period from a previous engine stop and an oil temperature. The VVT device has a start retard position for decompression which is positioned further in a retard direction than the most retarded position under normal operation. With an elapse of a delay time or lag of Δt after cranking, a hydraulic control valve is controlled for an advance operation. When filled with operating oil, the delay time Δt is set for t1 with a short time period, while for the situation in which oil has drained off the delay time Δt is set for t2 with a long time period. A sufficient start acceleration performance is maintained when filled with oil. A strange noise will be prevented from occurring in the case of oil drainage.

A variable valve timing (VVT) device of a hydraulically driven type (i.e., driven by engine oil pressure) is, in general, positioned in a upper location or upward of the internal combustion engine such as in the end portion of the cam shaft. Associated with the engine stop operation, an oil pump driven by the ICE also stops, and an operating oil drains out of the VVT oil chambers (an advance oil chamber or a retard oil chamber) and air may at least partially intruded inside the VVT oil chambers. When the VVT device is driven under such state, a relative vibration between a housing and a rotor will occur to generate a strange noise.

Even if a locking pin is provided which holds the rotor in a retarded position for the decompression operation, i.e., mechanically at the most retarded position of the VVT device, with a start of advancing control of a hydraulic control valve in which the hydraulic valve is switched to allow the advance chamber in communication with a oil pump delivery side, the locking pin will come out due to rise in air pressure in advance of the operating oil being filled, causing the rotor to be free to move and subject to vibration.

The improvements described herein relate to an internal combustion engine having a control system and a hydraulically-driven variable valve timing device for adjusting the open and close timings of the intake valve. The VVT device is configured to have a structural, start retarded position for use during a decompression a start-up of the internal combustion engine that is even more retarded than the most retarded position during a normal operation.

Moreover, the VVT device is configured to start a cranking operation while the VVT device is at the start retarded position in response to an engine start. During an engine start, a determination will be made as to whether or not the operating oil has drained off from the VVT device at the cranking start operation. If the operating oil is determined to have spilled or drained off, a delay time from the cranking start to the initiation of advancing operation of the VVT will be set longer the time for operating oil to be filled or replete.

If the delay time is short, the valve timing of the intake valve will be advanced in response, from the engine start retarded position for decompression to the original advanced position. Therefore, a torque which was suppressed by the VVT will be quickly recovered.

If the delay time is longer, operating oil will be quickly introduced in the retard chamber which is in a expanding condition from a oil pressure source while assuring a swift suppression of the rotor vibration.

As described herein, depending on whether or not operating oil drains off from the VVT device when starting a cranking, a start timing of advancing control from the retarded position for a start up of the engine will be adjusted properly. Therefore, for example, when the engine stops for a prolonged time and the operating oil drains off from the VVT device, a rotor vibration with a strange noise will be avoided and a start acceleration performance immediately after the standing state will be secured.

In one embodiment, an internal combustion engine is described including a hydraulically-driven variable valve timing device for adjusting the opening timing and the closing timing of an intake valve and configured to include a start retard position for decompression that is retarded further from the most retarded position during a normal operating state. The engine further includes a control system configured to start a cranking operation of the internal combustion engine while the variable valve timing device is positioned in the start retard position for decompression, to determine during the cranking operation whether operating oil has drained from the variable valve timing device, and when it has been determined that oil has drained from the variable valve timing device, to set a delay time between the cranking operation start and an advance operation of the variable valve timing device longer than the situation in which operating oil is replete.

In another embodiment, a method is described for controlling the startup of an internal combustion engine having a hydraulically-driven variable valve timing device for adjusting the opening timing and the closing timing of an intake valve and configured to include a start retard position for decompression retarded further from the most retarded position during a normal operating state. The method includes starting a cranking operation of the internal combustion engine while the variable valve timing device is positioned in the start retard position for decompression, determining during the cranking operation whether operating oil has drained from the variable valve timing device, and when it has been determined that oil has drained from the variable valve timing device, setting a delay time between the cranking operation start and an advance operation of the variable valve timing device longer than the situation in which operating oil is replete.

In another embodiment, an internal combustion engine is described having hydraulically-driven variable valve timing means for adjusting the opening timing and the closing timing of an intake valve and configured to include a start retard position for decompression that is retarded further from the most retarded position during a normal operating state. The engine further includes control means configured to start a cranking operation of the internal combustion engine while the variable valve timing device is positioned in the start retard position for decompression, to determine during the cranking operation whether operating oil has drained from the variable valve timing device, and when it has been determined that oil has drained from the variable valve timing device, to set a delay time between the cranking operation start and an advance operation of the variable valve timing device longer than the situation in which operating oil is replete.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

FIG. 3 is a vertical cross-sectional view of the variable valve timing device of FIG. 2 in conjunction with a hydraulic control valve.

FIGS. 4A and 4B are timing charts of the variable valve timing device showing (A) the most retarded position during a normal operation, and (B) the retarded position for decompression operation at start up, respectively.

DETAILED DESCRIPTION OF THE PREFERRED EMBODIMENTS

In the following, an explanation of an embodiment according to the present invention will be made with reference to accompanying drawings.

Figure 1:
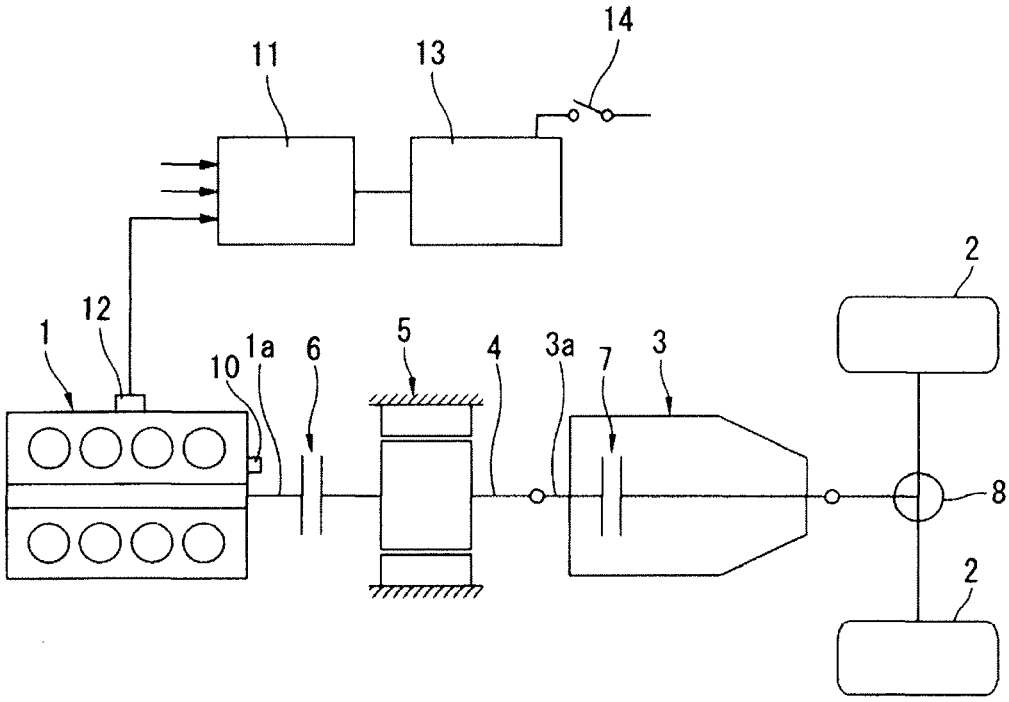
FIG. 1 is a schematic diagram showing an overall configuration of a hybrid electric vehicle to which the present invention may be applied.

FIG. 1 is a schematic of a basic configuration of a hybrid electric vehicle (HEV) to which an internal combustion engine control system as described herein can be applied. FIG. 1. shows an embodiment of power train of such an HEV with a front engine, rear-wheel drive type, which includes an internal combustion engine 1 and driving wheels (rear wheels) 2.

In the power train of the HEV shown in FIG. 1, as in the conventional rear-wheel drive vehicle, an automatic transmission 3 is connected in series with the internal combustion engine 1 at a downstream position, and a motor/generator 5 is provided integral with a shaft 4 interposed between crankshaft 1*a* of the engine 1 and an input shaft 3*a* of automatic transmission 3.

The motor/generator 5 is composed of a synchronous motor which uses a permanent magnet for a rotor, and may be operable as a motor to provide driving power in driving state, as well as a generator to generate electricity for storage in a battery in a regenerative state. A first clutch 6 is interposed between motor/generator 5 and internal combustion engine 1. The first clutch 6 is configured such a way to selectively connect and disconnect between the internal combustion engine 1 and the motor/generator 5 and further to control continuously a transmission torque capacity.

A second clutch 7 is interposed between the motor/generator 5 and the driving wheels 2, and more specifically between the shaft 4 and the automatic transmission 3. The second clutch 7 selectively connects and disconnects between motor/generator 5 and automatic transmission 3. The second clutch 7 is configured, as is the first clutch 6, to be capable of continuously changing a transmission torque capacity. The second clutch 7 may composed of a wet type multi-plate clutch to provide a controlled torque transfer capacity by continuously controlling a clutch operating pressure by way of a proportional solenoid valve.

The automatic transmission 3 is capable of realizing seven forward speed ratios and one rearward speed ratio by selectively engaging or disengaging a plurality of friction elements (such as clutches and brakes) whose output is passed via a differential gear to a left and right driving wheels (rear wheels) 2. Note that a conventional or existing friction element for forward drive or a friction element for a rearward regeneration may be commonly used as the second clutch 7. The second clutch 7 does not require a single specified friction element, but an appropriate friction element which functions as a second clutch depending on a speed change ratio.

In a hybrid electric vehicle of the type described above, two operational modes are available. In an electric vehicle drive mode (EV mode), the motor/generator 5 provides the only driving power source, whereas in a hybrid drive mode (HEV mode), the internal combustion engine 1 is involved in addition to the motor/generator 5 as a driving power source. For example, in a low load, low vehicle speed state such as in a slow start from a vehicle standing state, an EV mode is sufficient. In the EV mode, the internal combustion engine 1 is maintained stopped (not running) with first clutch 6 disengaged, and a vehicle is driven by solely by the motor/generator 5. Alternatively, when running at a high speed or under heavy load, an HEV mode is required. In the HEV mode, both the first clutch 6 and the second clutch 7 are engaged and the vehicle is propelled by power from both the internal combustion engine 1 and the motor/generator 5.

In the transition from the EV mode to the HEV mode, an engine start, i.e., a cranking operation, must occur. The engine start is accomplished by connecting or engaging the first clutch 6 for transferring a torque from the motor/generator 5. In this situation, by controlling a transmission torque capacity of the first clutch 6 variably and operating the first clutch 6 in a slip-engagement manner, a smooth or stable transition will be ensured.

In addition, the second clutch 7 functions as a start-up clutch and enables a smooth start by absorbing torque fluctuations even in a power train path without a torque converter, by variably controlling a transfer torque capacity in a slip-engagement manner. Alternatively, the second clutch 7 may be provided as an independent, separate clutch and may be interposed between the motor/generator 5 and the automatic transmission 3, or between the automatic transmission 3 and a differential gear device 8, for example.

The internal combustion engine 1 may be a four-stroke cycle gasoline engine or diesel engine. At its air intake valve side, by relatively rotating a phase of the cam shaft (not shown) with respect to that of the crankshaft 1*a*, a hydraulically-driven variable valve timing device (VVT) 10 is provided in which both the opening timing and the closing timing of the intake valve are simultaneously adjusted. The VVT device 10 uses as a hydraulic source a lubricating oil of the internal combustion engine 1. The VVT device 10 drives a cam shaft to rotate by selectively supplying or draining oil pressure via a hydraulic control valve (described in detail below) in order to follow a target variable timing control (VTC) angle which is determined based on the parameters such as a load and a rotation speed of the engine 1. The VTC angle denotes a phase difference between the cam shaft and the crankshaft expressed in terms of crankshaft angle.

Note that, the present invention may be equally applicable to an internal combustion engine with a variable valve timing device on both the inlet and exhaust valves. Also, the present invention may be applied to a vehicle driven by a internal combustion engine only, and is not restricted to use on an HEV.

The internal combustion engine 1 and the VVT device 10 are controlled by an engine controller 11. The engine controller 11 is supplied with various sensor detect signals including an oil temperature signal from a oil temperature sensor 12 for detecting an oil temperature of lubricating oil of the internal combustion engine 1. The motor/generator 5 is controlled by a motor/generator controller (not shown). A unified controller 13 is provided to control the first clutch 6 and the second clutch 7, and is further connected to engine controller 11 and motor/generator controller. An ignition switch 14 operated by a driver is connected to the unified controller 13. The start and stop operations of internal combustion engine are executed in response to commands from the unified controller 13 via the engine controller 11.

Figure 2:
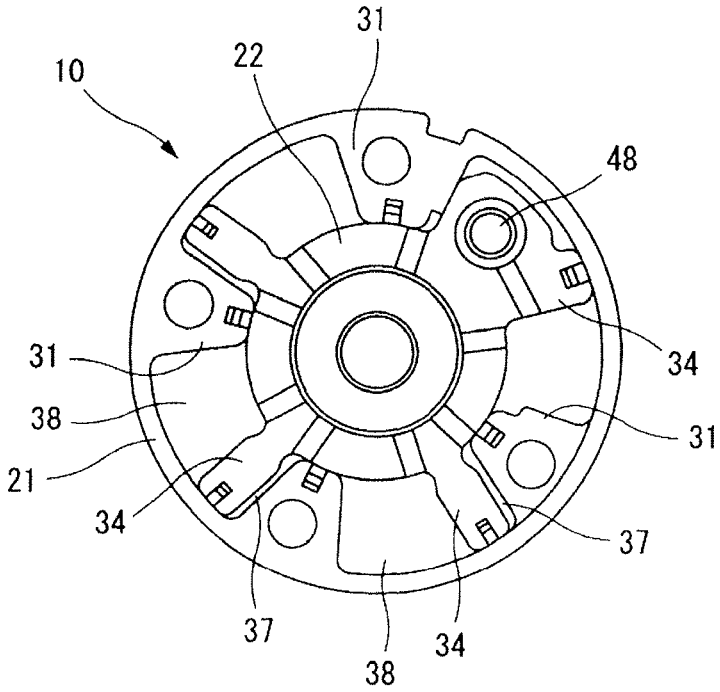
FIG. 2 is a transverse cross-sectional view of an embodiment of a variable valve timing device.

FIG. 2 and FIG. 3 show an embodiment of VVT device 10. As shown, the VVT device 10 includes a housing 21 have a generally cylindrical shape and a rotor 22 coaxially accommodated within the housing 21. On the periphery of the housing 21 may be a cam sprocket (not shown), around which is wound a timing chain (not shown) which is also wound around a crank sprocket (not shown) of the crankshaft 1*a*. In addition, the rotor 22 is fixed to a front end of the cam shaft by a center bolt (not shown).

Four partition walls 31 extend radially inward from the inner circumference of the housing 21, and four vanes 34 extend radially outward from the outer circumference of the rotor 22. The walls 31 and the vanes 34 are meshed with each other, and by this arrangement, the rotor 22 and the housing 21 are rotatable relatively to each other within a preset angle range. In addition, between two neighboring partition walls 31, two oil chambers, including an advance chamber 37 and a retard chamber 38, are respectively formed on opposite sides of each vane 34 and between adjacent walls 31. In other words, when pressurized oil is introduced in the advance chamber 37, the rotor 22 is rotated relative to the housing 21 in the direction of advancing the valve timing, whereas, when pressurized oil is introduced in retard chamber 38, the rotor 22 is rotated relative to the housing 21 in the direction of retarding the valve timing. It should be noted here that at least one vane 34 will be in contact with a side surface the partition wall part 31 of the housing 21 when the rotor 22 is positioned in the most advanced position or most retarded position. In FIG. 2, for example, the rotor 22 is shown to be in a structurally most retarded position.

The four advance chambers 37 are in fluid communication with an external advance side hydraulic conduit 41 as schematically shown in FIG. 3. Similarly, the four retard chambers 38 are in fluid communication with an external retard side hydraulic conduit 42. As a hydraulic pressure source to change valve timing, an oil pump 43 is provided. The hydraulic conduits 41, 42 are selectively connected to the oil pump 43 or to drain conduits 44, 45, respectively, via an electromagnetic hydraulic control valve 46. Thus, the oil pump 43 and the drain conduits 44, 45 are selectively in communication with the advance chambers 37 and retard chambers 38, respectively.

The hydraulic control valve 46 includes a solenoid and is configured to change the oil pressure within advance chamber 37 and retard chamber 38 continuously by way of an on-off duty cycle based on a driving signal of appropriate frequency. In particular, when the solenoid is not energized, a hydraulic circuit is configured in such a way that an initial position of a spool is set by a return spring (not shown) in which the advance chambers 37 are in fluid communication with the drain conduit 44, while the retard chambers 38 are in fluid communication with the oil pump 43. Therefore, in this embodiment, when the engine stops and the solenoid is not energized, the rotor 22 assumes the most retarded position as illustrated in the FIG. 2.

Further, in one of the vanes 34 of the rotor 22, a lock pin 48 is provided to fixedly hold the rotor 22 at the most retarded position. As shown in FIG. 3, by inserting an end 48*a* of the lock pin 48 into a recessed portion 49 of the housing 21, the rotor 22 will be fixed and prevented from rotating. A coil spring 50 biases the lock pin 48 in the direction to engage with the recessed portion 49, and in order to release the lock pin 48, oil pressure may be introduced from the advance side hydraulic conduit 41. In other words, in the most retarded position of the rotor 22, the lock pin 48 is engaged by way of biasing force of the coil spring 50, and then, when oil pressure is introduced into the advance chambers 37 via the advance side hydraulic conduit 41 to advance the rotor 22, the lock pin 48 will retract to release the locking of the rotor 22.

Alternatively, in the instant invention the hydraulic control valve 46 may be of a simple switching valve without a duty cycle ratio control.

It should be noted that the above described VVT device 10 is provided with a startup decompression retard position which lies even further in the retarded direction from the most retarded position during a normal operation. FIG. 4 comparatively illustrates (A) an example of valve timing at the most retarded position during a normal operation, and (B) an example of valve timing during a startup decompression operation. In this example, at the most retarded position during a normal operation, an opening timing of intake valve (IVO) advances substantially prior to top dead centre (TDC), and closing timing of intake valve (IVC) lies 50 to 60 crank angle degrees after bottom dead centre (BDC).

However, the structural most retarded position held by lock pin 48 is a retarded position that may be used as a start retard position during a startup decompression operation. By conducting a cranking operation at this position, a smooth start with less vibration will be enabled. In addition, as described below, after a predetermined elapsed time, the valve timing begins to advance to a target VTC angle prevailing at that timing, thus ensuring a required amount of torque.

In the hybrid vehicle associated with a transition between an EV mode and an HEV mode, automatic stop and start operations will frequently take place. For example, at a temporary stop of the vehicle at intersections, the vehicle operates in an EV mode and the internal combustion engine 1 stops. Then, when at the vehicle starts, the accelerator pedal will be pressed down greatly, and an immediate transition to the HEV mode will take place causing the internal combustion engine 1 to be automatically started. In such situations, the delay time is set to be shorter to allow for an immediate rise in a torque of internal combustion engine 1 and better start acceleration performance.

On the other hand, since the VVT device 10 is located at the height of cam shaft, during the period in which the oil pump 43 of the internal combustion engine 1 stops and operating oil (engine lubricant) drains off, the VVT device 10 may be filled with air. When operating oil is not filled within the advance chambers 37 and the retard chambers 38, and the hydraulic control valve 46 is changed in the advance direction, the rotor 22 vibrates in the absence of operating oil and generates a strange noise. More specifically, by connecting the advance chambers 37 with the oil pump 43, pressure will be applied on the lock pin 48 in the recessed portion 49 (air pressure or oil pressure), and the lock will be released prior to the advance chambers 37 being filled with operating oil. Then, the rotor 22 becomes unrestricted and is subject to uncontrolled vibration resulting in a strange noise created by friction with the housing 21. Therefore, to overcome this problem, in the present invention, depending on whether or not operating oil has drained or spilled off from the VVT device 10, the time delay will be set variably.

Figure 5:
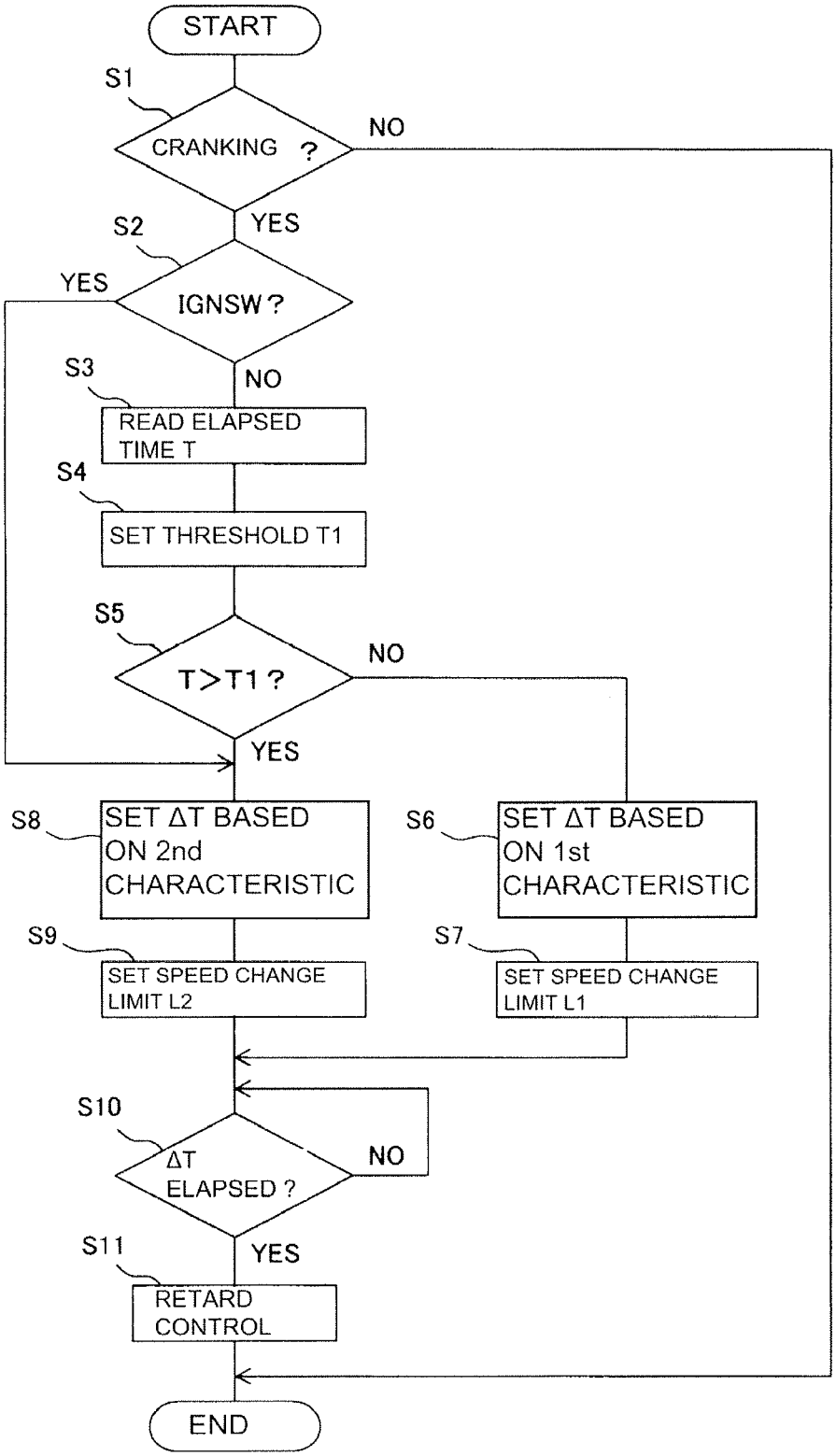
FIG. 5 is a flow chart showing a flow of control routines at start up.

FIG. 5 is a flow chart showing processing routines of the VVT device 10 executed by an engine controller 11 at the start of the internal combustion engine 1. At step S1, a determination is made as to whether the engine is in a start phase or not, i.e., whether or not a cranking operation is started by the motor/generator 5. If determined YES, a determination is made at step S2 as to whether the start is an initial starting operation initiated by the driver by operating an ignition switch 14, or an automatic start initiated during vehicle operation. In this embodiment, when the engine is decided to be stared initially by driver ON operation of the ignition switch 14 (a determination of YES in step S2), no change in delay time will be made regardless whether the operating oil drains off or not.

Figure 6:
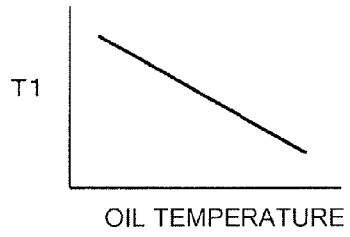
FIG. 6 is a characteristic diagram showing a relationship between oil temperature and a threshold of elapsed time.

If determined NO in step S2 to indicate an automatic start, the control proceeds to step S3 and reads an elapsed time T after a previous automatic start of the internal combustion engine 1. Subsequently, in step S4, based on the oil temperature detected by the oil temperature sensor 12, a threshold Ti will be set for comparison with the elapsed time T by referring to a preset table or graph. FIG. 6 shows an example of such a graph and indicates generally a smaller threshold T1 as the oil temperature becomes higher. This is because at a higher temperature, the viscosity of the oil is lower, and lower viscosity oil drains off more easily. Although oil temperature at the start timing of engine is read, the oil temperature or even an overage average temperature during the engine stop may well be considered.

In step S5, a comparison is made regarding the elapsed time T with the threshold T1, and if detected below the threshold T1. If $T \leq T1$ (NO in step S5), operating oil is regarded not to have drained off and the control further proceeds to steps S6 and S7. In step S6, a first characteristic will be selected as a basic characteristic defining the relationship between oil temperature and delay time. Based on this first characteristic, an appropriate amount of delay time $\Delta t$ is set. Subsequently, in step S7, regarding a change speed from the startup retarded position for decompression to the position corresponding the engine operating conditions prevailing at that time, a first change speed limit value L1 is set with a relatively large change speed.

On the other hand, if the elapsed time T has been determined to exceed threshold T1 ($t > T1$) at step S5 (YES), it is assumed that operating oil has drained out from the VVT device 10 and control proceeds to steps S8 and S9. Similarly, in step S2, if an initial start by operation of the ignition switch 14 has been determined (YES in step S2), the control proceeds to steps S8 and S9. In step S8, a second characteristic with a relatively prolonged delay time $\Delta t$ is selected regarding the relationship between oil temperature and delay time. Subsequently, in step S9, regarding a change speed from the startup retarded position for decompression to the position corresponding to the engine operating conditions prevailing at that time, a second change speed limit value L2 is set with a relatively small change speed.

In step S10, it is determined whether or not the delay time $\Delta t$ has passed. Upon the delay time $\Delta t$ being exceeded, control further goes to step S11. As explained above, during the delay time $\Delta t$, the hydraulic control valve 46 of the VVT device 10 assumes an initial position (i.e., the spool is biased in a non-energized position by the return spring) in which advance chambers 37 are connected to the drain conduit 44 while the retard chambers 38 are connected to the oil pump 43. Therefore, the rotor 22 remains locked in its initial start retard position for decompression. In step S11, the VVT device 10 is allowed to advance and control of the VVT device 10 is started.

Figure 7:
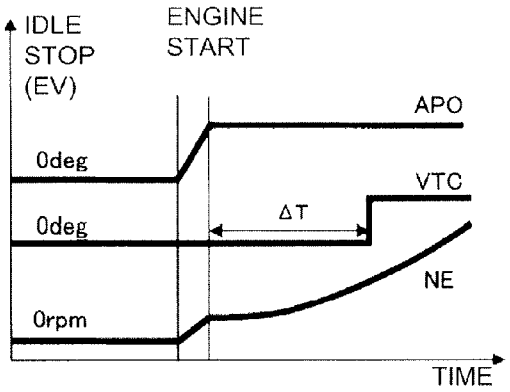
FIG. 7 is a timing chart showing various parameters at an automatic start operation from an idle stop state.

In FIG. 7, an example is shown in which a sudden increase of accelerator opening (APO) is exhibited from a vehicle temporary stop condition with the internal combustion engine 1 stopping (an idle stop condition). In other words, FIG. 7 shows the response of the engine 1 when the vehicle is stopped, the engine is stopped, and a driver steps on the accelerator pedal. As shown, with an increase of accelerator opening APO, the internal combustion engine 1 starts and increases an engine rotation speed (NE) while the VVT device 10 maintains the VTC start retard position for decompression during the delay time $\Delta t$.

Figure 8:
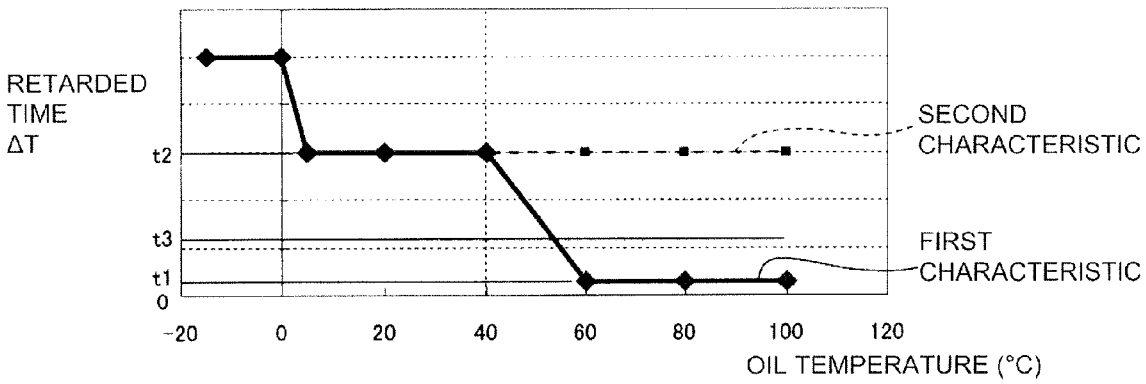
FIG. 8 is a characteristic diagram showing characteristics of a delay time versus oil temperature.

In FIG. 8, the first characteristic and second characteristic described in the above described steps S6 and S8 are illustrated. A solid line marked with diamonds indicates a basic, first characteristic and defines a delay time $\Delta t$ depending on oil temperature. According to the first characteristic, the delay time Δt is set for a relatively short time t1 for an oil temperature at or above 60° C., considering a sufficient start acceleration performance. For a lower oil temperature below 60° C., the delay time Δt is set longer. The threshold value for oil temperature of 60° C. corresponds to one of the conditions (e.g., a warm-up) enabling an idle stop operation (automatic stop operation) of the internal combustion engine 1. Therefore, the area of less than 60° C. oil temperature is not used for an automatic start operation.

The second characteristic which is applied when operating oil has drained off is shown by a dashed line marked with squares in FIG. 8. In the area of less than 40° C. oil temperature, the second characteristic overlaps with the first characteristic, i.e., there is no difference between the first and second characteristics. According to the second characteristic in the area of more than 40° C. oil temperature, the delay time Δt is set with a relatively long time t2, which is the same value for the area of oil temperature or equal to less than 40° C.

When operating oil has been drained off the advance chambers 37 and the retard chambers 38 of the VVT device 10 during an engine stop state, and because during the delay time Δt the retard chambers 38 are in fluid communication with the oil pump 43 via the hydraulic control valve 46, upon a sharp rise of oil pressure by the oil pump 43 in response to a cranking operation, the retard chambers 38 will be immediately filled with operating oil.

As a result, the rotor 22 (via the vane 34) is securely restrained by operating oil at a structural most retarded position (start retard position for decompression) and is free from vibration. Although in FIG. 2 it can be seen that the lock pin 48 fixes the rotor 22, regardless of the presence or absence of the lock pin 48, vibration of the rotor 22 will be prevented.

As has been explained above, a determination is made regarding whether or not operating oil has drained off from the VVT device 10 based on a stopping time period of the internal combustion engine 1, and the delay time Δt is accordingly set for an appropriate value. Therefore, in the case of a short stopping time period without fear of oil draining out, a sufficient amount of torque will be obtained immediately upon start of the internal combustion engine 1 with a high start acceleration performance. On the other hand, even if operating oil has drained off due to a long time stopping period, vibration of the rotor 22 and thus occurrence of an associated strange noise will be prevented.

Incidentally, in a hybrid vehicle as in the above described embodiment, torque fluctuations are absorbed for ensuring a smooth start by variable control of a transmission or transfer torque capacity of the second clutch 7 for a slip engagement. According to the embodiment, this slip engagement period of the second clutch 7, i.e., a time period until complete engagement of the second clutch 7 after a vehicle start accompanied by an automatic start of internal combustion engine 1, is defined to be an intermediate time t3 which is between t1 along first characteristic and t2 along second characteristic as is shown in FIG. 8. More specifically, when the delay time Δt is set to be time t1, the VVT device 10 is advanced while the second clutch 7 is in a slip engagement condition so that torque fluctuations associated with advance operation will be absorbed easily. In contrast, when the delay time Δt is t2, the VVT device 10 is advanced after the second clutch 7 has been engaged completely, thus with occurrence of torque fluctuations.

Figure 10:
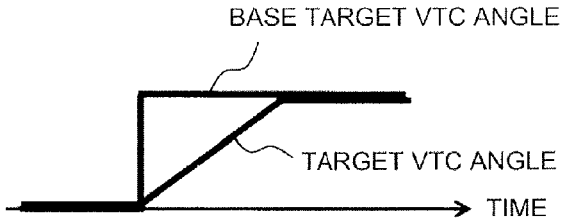
FIG. 10 is a timing chart showing a relationship between a basic target VTC angle and a target VTC angle as adjusted by a change speed limit.

In order to avoid shock of the vehicle due to changes in torque such as this, as described with respect to steps S7 and S9, different change speed limits L1 and L2 are defined as a change speed for advance (angular velocity) in VTC angle to the target VTC angle from a start retard position for decompression. In other words, as shown in FIG. 10, when an advance was permitted in step S5 in FIG. 5, the basic target VTC angle changes stepwise. However, the target VTC angle set for an actual target value will be restrained by its change speed (i.e., the inclination angle in FIG. 10) and a gradual advance will be performed. Further, when the delay time Δt is set longer due to a determination drainage of operating oil, the target VTC angle change speed will be set even slower. Therefore, uncomfortable shock experienced by the driver will be suppressed immediately.

On the other hand, when the operating oil has not drained out and the delay time Δt is thus set for a shorter time, a relatively large change speed is preferable so that the advance operation of VVT device 10 will be completed while the second clutch 7 is a slip engagement state.

As for the change speed in the target VTC angle, other different parameters may be considered such as, for example, a fuel property, i.e., whether the fuel is gasoline or diesel fuel. Additionally, it may be conceivable to set greater change speed as accelerator pedal openness APO increases.

Note that when the initial start operation is due to an ON operation of the ignition switch 14, a determination of operating oil drainage is not made because of no substantial effect on a start acceleration performance. However, as in the case of automatic start, depending on the elapsed time T from the previous engine stopping, the delay time Δt may be changed.

Figure 9:
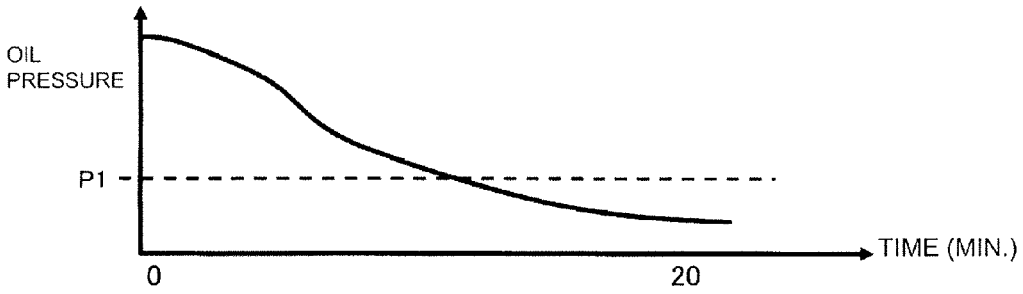
FIG. 9 is a characteristic diagram showing a change of a hydraulic oil pressure within the hydraulic system as a function of the elapsed time from the engine stop state.

In addition, an indirect determination is made whether operating oil has drained off or not based on a stopping time period of the internal combustion engine 1. Alternatively, an oil pressure sensor 47 may be disposed in an oil pressure conduit (such as in the advance oil conduit 41) and based on the detected oil pressure, a determination can be made whether or not operating oil has drained out. More specifically, as shown in FIG. 9, for example, oil pressure in the advance hydraulic conduit 41 decreases over time after an engine stop, and upon reaching a prescribed oil pressure P1, the VVT device 10 is not capable of maintaining the condition with operating oil replete, since a drainage of oil has begun. Therefore, based on the actual detected oil pressure, a determination is made as to the presence or absence of oil drainage.

Incidentally, as is apparent from FIG. 9, the elapsed time up until reaching oil pressure P1 corresponds to the threshold described above.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. An internal combustion engine utilized in a hybrid electric vehicle with a clutch interposed in a power drive line from the internal combustion engine to driving wheels for a slip engagement at a start of the internal combustion engine, the internal combustion engine comprising:

a hydraulically-driven variable valve timing device for adjusting an opening timing and a closing timing of an intake valve and configured to include a start retard position for decompression during a starting operation state that is retarded further from the most retarded position during a normal operating state;

an oil temperature sensor for detecting an oil temperature of an operating oil; and a control system configured:

to start a cranking operation of the internal combustion engine with the clutch being in a slip engagement state while the variable valve timing device is positioned in the start retard position for decompression;

to set a threshold for determining whether the operating oil has drained from the variable valve timing device, the threshold being set to be smaller as the detected temperature of the operating oil is higher;

to determine during the cranking operation that the operating oil has drained from the variable valve timing device when an elapsed time after a previous stop of the engine exceeds the threshold;

to retain the start retard position for decompression with a delay time which is longer when the elapsed time exceeds the threshold than a situation in which the elapsed time is below the threshold; and to set a change speed of the variable valve timing device to a target valve timing at the start of an advance operation of the variable valve timing device subsequent to the delay time, the change speed being set based on the delay time and a time period until complete engagement of the clutch.

2. The internal combustion engine of claim 1, wherein the threshold for determining whether the operating oil has drained is based on a stopping time period elapsed since an engine stop.

3. The internal combustion engine of claim 1, further comprising an oil pressure sensor for detecting an oil pressure in a hydraulic conduit within the variable valve timing device, wherein the threshold for determining whether the operating oil has drained is based on the detected oil pressure.

4. The internal combustion engine of claim 1, wherein the control system is further configured to conduct automatic stop and start operations of the internal combustion engine based on a vehicle operating condition.

5. The internal combustion engine of claim 4, wherein the change speed varies inversely with the delay time.

6. A method of controlling the startup of an internal combustion engine having a hydraulically-driven variable valve timing device for adjusting an opening timing and a closing timing of an intake valve and configured to include a start retard position for decompression during a starting operation state that is retarded further from the most retarded position during a normal operating state, the internal combustion engine utilized in a hybrid electric vehicle with a clutch interposed in a power drive line from the internal combustion engine to driving wheels for a slip engagement at a start of the internal combustion engine, the method comprising:

detecting an oil temperature of an operating oil;

starting a cranking operation of the internal combustion engine with the clutch being in a slip engagement state while the variable valve timing device is positioned in the start retard position for decompression;

setting a threshold for determining whether the operating oil has drained from the variable valve timing device, the threshold being set to be smaller as the detected temperature of the operating oil is higher;

determining during the cranking operation that the operating oil has drained from the variable valve timing device when an elapsed time after a previous stop of the engine exceeds the threshold;

retaining the start retard position for decompression with a delay time which is longer when the elapsed time exceeds the threshold than a situation in which the elapsed time is below the threshold; and setting a change speed of the variable valve timing device to a target valve timing at the start of an advance operation of the variable valve timing device subsequent to the delay time, the change speed being set based on the delay time and a time period until complete engagement of the clutch.

7. The method of claim 6, wherein the threshold for determining whether the operating oil has drained is based on a stopping time period elapsed since an engine stop.

8. The method of claim 6, further comprising detecting an oil pressure in a hydraulic conduit within the variable valve timing device, wherein the threshold for determining whether the operating oil has drained is based on the detected oil pressure.

9. The method of claim 6, further comprising conducting automatic stop and start operations of the internal combustion engine based on a vehicle operating condition.

10. The method of claim 9, wherein the change speed varies inversely with the delay time.

11. An internal combustion engine utilized in a hybrid electric vehicle with a clutch interposed in a power drive line from the internal combustion engine to driving wheels for a slip engagement at a start of the internal combustion engine, the internal combustion engine comprising:

hydraulically-driven variable valve timing means for adjusting an opening timing and a closing timing of an intake valve and configured to include a start retard position for decompression during a starting operation state that is retarded further from the most retarded position during a normal operating state;

an oil temperature sensing means for detecting an oil temperature of an operating oil; and control means configured:

to start a cranking operation of the internal combustion engine with the clutch being in a slip engagement state while the variable valve timing device is positioned in the start retard position for decompression;

to set a threshold for determining whether the operating oil has drained from the variable valve timing device, the threshold being set to be smaller as the detected temperature of the operating oil is higher;

to determine during the cranking operation that the operating oil has drained from the variable valve timing device when an elapsed time after a previous stop of the engine exceeds the threshold;

to retain the start retard position for decompression with a delay time which is longer when the elapsed time exceeds the threshold than a situation in which the elapsed time is below the threshold; and to set a change speed of the variable valve timing device to a target valve timing at the start of an advance operation of the variable valve timing device subsequent to the delay time, the change speed being set based on the delay time and a time period until complete engagement of the clutch.

* * * * *